US005579837A

United States Patent [19]

Yu et al.

[11] Patent Number: 5,579,837

[45] Date of Patent: Dec. 3, 1996

[54] HEAT EXCHANGER TUBE AND METHOD OF MAKING THE SAME

[75] Inventors: Wen F. Yu, West Bloomfield; Eugene E. Rhodes, Belleville, both of Mich.

[73] Assignee: Ford Motor Company, Dearborn, Mich.

[21] Appl. No.: 559,400

[22] Filed: Nov. 15, 1995

[51] Int. Cl.[6] ..... F28F 1/02

[52] U.S. Cl. ..... 165/183; 165/177; 165/DIG. 537; 29/890.053

[58] Field of Search ..... 165/177, 183; 29/890.053

[56] References Cited

U.S. PATENT DOCUMENTS

| | | |
|---|---|---|
| 2,085,191 | 6/1937 | Hastings . |
| 2,448,648 | 9/1948 | Zideck . |
| 4,243,020 | 1/1981 | Mier . |
| 4,971,240 | 11/1990 | Wallis . |
| 5,186,250 | 2/1993 | Ouchi et al. . |
| 5,314,021 | 5/1994 | Potier et al. . |
| 5,441,105 | 8/1995 | Brummett et al. . |
| 5,441,106 | 8/1995 | Yukitake ..... 165/183 |

FOREIGN PATENT DOCUMENTS

| | | |
|---|---|---|
| 0302232 | 8/1989 | European Pat. Off. . |
| 136093 | 8/1982 | Japan . |
| 780045 | 7/1957 | United Kingdom . |

*Primary Examiner*—Leonard R. Leo
*Attorney, Agent, or Firm*—Raymond L. Coppiellie

[57] ABSTRACT

There is disclosed herein a heat exchanger tube having an elongated, generally rectangular member including a planar base, a top, and pair of arcuate opposed side portions interposed between the base and the top. A partition extends from the top to the base to define a pair of fluid passageways, the partition including a pair of opposing, contacting bend portions and a leg portion depending from each of the bend portions which contact the base. Each of the leg portions is disposed at an acute angle relative to a vertical plane and spaced apart a predetermined distance so as define a braze receiving fillet therebetween. A method of manufacturing such a tube is also disclosed.

12 Claims, 2 Drawing Sheets

HEAT EXCHANGER TUBE AND METHOD OF MAKING THE SAME

FIELD OF THE INVENTION

The present invention relates generally to heat exchanger tubes. More particularly, the present invention relates to heat exchanger tubes for use in an automotive vehicle and a method for making the same.

DISCLOSURE INFORMATION

Heat exchanger tubes carry first a fluid medium while a second fluid medium is in contact with the exterior to the tube. Typically, the second fluid medium is air. Where a temperature difference exists between the first and second media, heat will be transferred between the two via the heat conductive walls of the tube.

It is known to provide a corrugated fin or rib in the interior of a heat exchanger tube to increase the surface area of conductive material available for heat transfer, to cause turbulence of the fluid carried in the interior of the tube and to increase the burst strength of the tube. One known method of creating such a tube is to physically insert a corrugated fin into the generally flattened tube after the tube has been manufactured. This is an extremely difficult process since the corrugated fin to be inserted into the tube is extremely thin and subject to deformation during the insertion process.

Another known method is to extrude the tube in an extrusion process. In this construction, internal ribs are formed during the extrusion. However, these extruded heat exchanger tubes are expensive to produce.

It has also been known to fabricate a heat exchanger tube from a planar piece of deformable material by bending the terminal edges of the sheet toward one another and then ultimately to the bottom of the sheet to form a pair of fluid passageways. EPO patent number 0 302 232 shows one such method wherein the terminal edges of a sheet of material are rolled toward the center of the sheet material and brazed to the base of the material. However, in such a manufacturing process, it is difficult to control the amount of braze material holding the terminal edges of the sheet to the base. If insufficient braze material secures the edges to the base, the overall tube structure is weakened. Therefore, it would be advantageous to provide a tube which is capable of withstanding high internal fluid pressures and which is reliable and easy to fabricate.

SUMMARY OF THE INVENTION

The present invention solves the problems associated with the prior art by providing a tube for a heat exchanging device, the tube comprising an elongate, generally rectangularly shaped member having a generally planar base, a top side including a braze seam and a pair of generally arcuate, opposed side portions interposed between the base and the top side. The tube further includes a partition extending from the top side to the base and which defines a pair of adjacent, elongated passageways. The partition includes a pair of opposing, contacting bend portions and a leg portion depending from each of the bend portions which contact the base. Each of the leg portions is disposed at a predetermined angle relative to a vertical plane perpendicular to the plane of the base. The leg portions are spaced apart a predetermined distance so as to define a braze receiving fillet therebetween.

There is further disclosed a method of forming a tube for a heat exchanger, comprising the steps of providing a sheet of elongate, deformable material have a longitudinal axis and a transverse axis. The sheet defines a generally planar base having a pair of terminal edges along a longitudinal length of the planar base. One side of the sheet is covered with the brazing material. The method further includes the steps of folding each of the terminal edges toward one another until they meet so as to form a pair of generally arcuate side portions and a top portion, the braze material being on an outer surface of the side top portions. The method also includes forming a pair of fluid passageways by bending the terminal edges inwardly toward the base at an acute angle until the terminal edges contact the base, this step also including forming a braze material receiving fillet area between these terminal edges. The method further includes coating an outside surface of the fluid passageways with a brazing flux and heating the fluid passageways at a predetermined temperature to melt the braze material, the flux causing the braze material to flow by capillary flow into the braze material receiving fillet area and substantially filling this area. The method concludes by cooling the tube to solidify the molten braze material to secure the fluid passageways to one another along the partition and to secure the terminal edges to the base at a predetermined angle to form the heat exchanger tube.

These and other objects, features and advantages of the present invention will become apparent from the drawings, detailed description, and claims which follow.

DETAILED DESCRIPTION OF THE PREFERRED EMBODIMENTS

Figure 1:
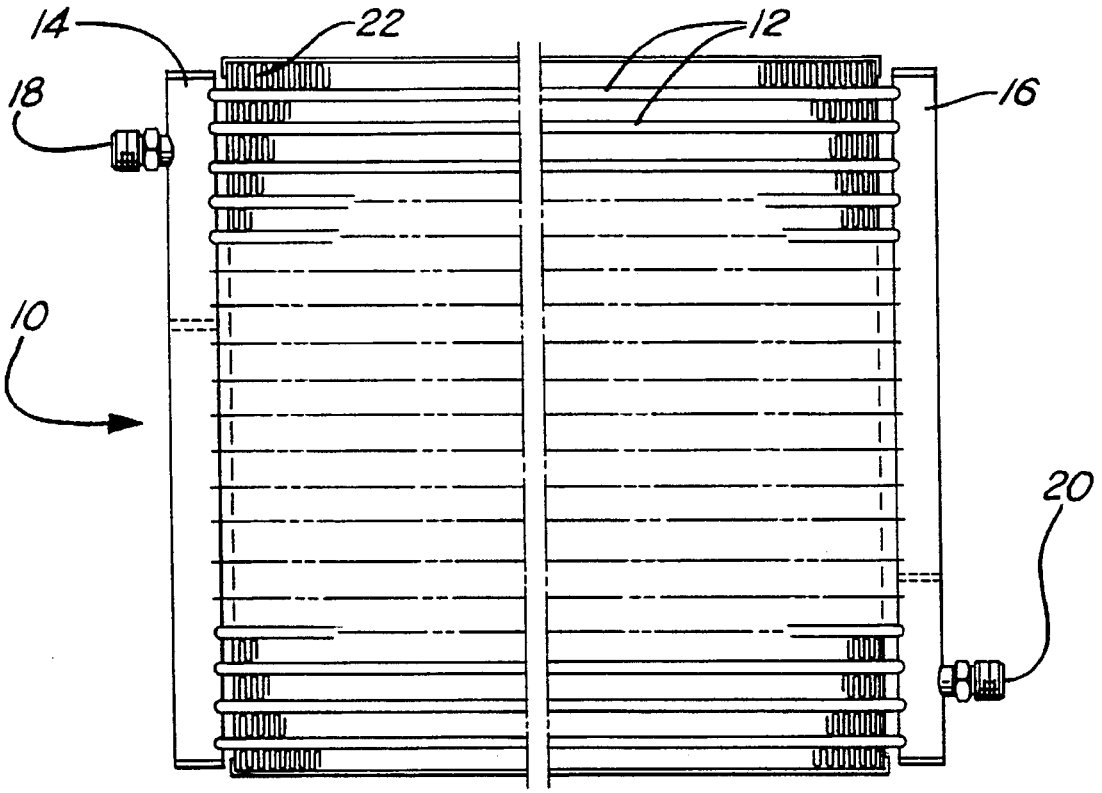
FIG. 1 is a perspective view of a heat exchanger for an automotive vehicle utilizing a heat exchanger tube of the present invention.

Referring to the drawings, FIG. 1 shows a heat exchanger 10 for use in automotive applications, such as radiator or a condenser. The heat exchanger includes a set of generally parallel tubes 12 extending between oppositely disposed headers 14, 16. A fluid inlet 18 for conducting cooling fluid into the exchanger 10 is formed in the header 14 and an outlet 20 for directing fluid out the heat exchanger 10 is formed in the header 16. Convoluted or serpentine fins 22 are attached exterior of each of the tubes 12 and serve as a means for conducting heat away from the tubes 12 while providing additional surface area for convective heat transfer by air flowing over the heat exchanger 10. The fins 22 are disposed between each of the tubes 12 of the heat exchanger 10.

Figure 2:
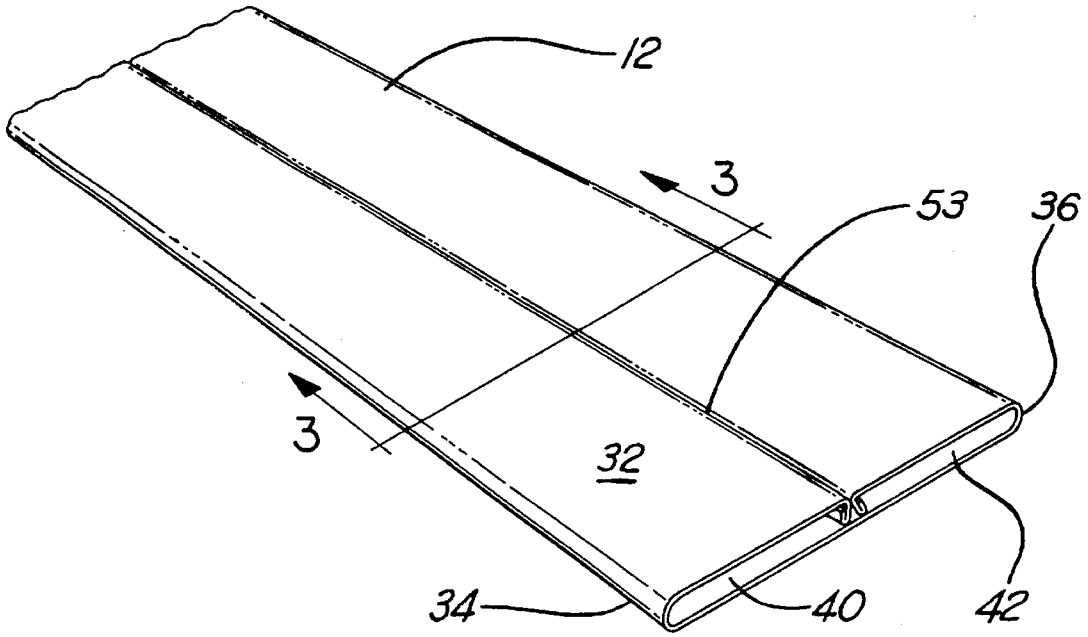
FIG. 2 is a perspective view of a heat exchanger tube of the present invention.
Figure 3:
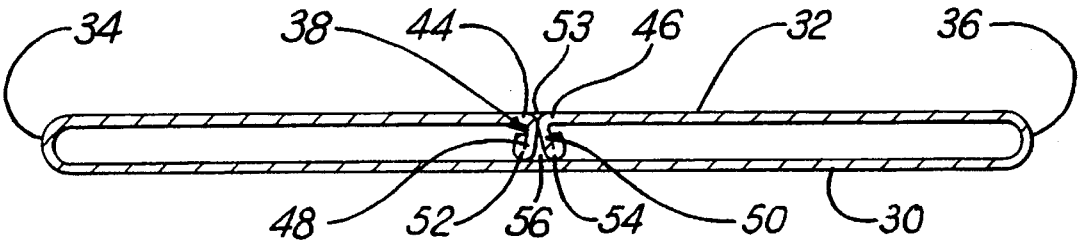
FIG. 3 is a cross sectional view taken along line 3—3 of the heat exchanger tube of FIG. 2.

FIGS. 2 and 3 show a cross-sectional view of one of the tubes 12 of the heat exchanger 10 of FIG. 1. The tube 12 is substantially flat as viewed in cross-section and includes a generally planar base 30, a top side 32 and a pair of generally arcuate, opposed side portions 34, 36 interposed between base 30 and the top side 32. As such, the tube 12 is generally rectangularly shaped. The tube further includes a partition 38 extending from the top side 32 to the base 30 and which defines a pair of adjacent of elongates fluid passageways 40, 42. The partition 38 includes a pair of opposing, connecting bend portions 44, 46 disposed at a predetermined radius of curvature toward one another. Each of the bend portions 44, 46 includes a leg portion 48, 50 respectively, depending from each of the bend portions 44, 46 and which contact the base 30 at terminal ends 52, 54 respectively. A braze seam 53 is disposed at the top of the partition along the longitudinal length of the tube 12.

Figure 4:
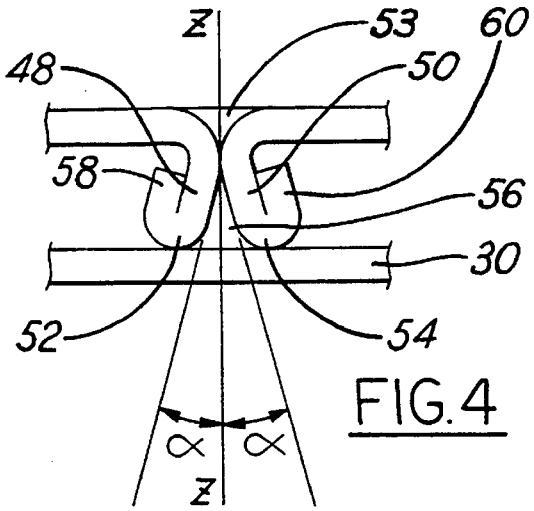
FIG. 4 is an enlarged view of a portion of the tube of FIG. 3.

As can be further seen in FIG. 4, each of the leg portions 48, 50 is disposed at a predetermined angle, α, relative to a vertical plane (designated by line Z—Z) perpendicular to the plane of the base 30. This angle, α, can range between 7 and 15 degrees and in the preferred embodiment is 10 degrees. Furthermore, the terminal ends 52, 54 of the leg portions 48, 50, respectively, are spaced apart a predetermined distance on the order of between 0.015–0.025 inches. As viewed through a cross-sectional plane as shown in FIG. 4, the area between the partition 38 and the terminal ends 52, 54 define a braze receiving area, or fillet 56 of predetermined area. This area can be between 0.108 to 0.235 mm square and provides for additional brazing strength. In this embodiment, the leg portions 48, 50 are not only secured together along partition 38 but are secured to the base portion 30 by the fillet 56. As such, more surface area of the partition and leg portion are connected to the base, thus increasing the overall burst strength of the tube 12. To further increase the strength of the tube, the leg portions 48, 50 at the terminal ends 52, 54 of the tube may include a bent over portion 58, 60. The bent over portions ensure a good braze connection of the leg portions 48, 50 to the base 30.

As will be explained in greater detail below the outer surface of the tube is coated with a known brazing material and the brazing material flows into the braze material receiving fillet 56 through the partition 38 by capillary flow action.

Figure 5A:
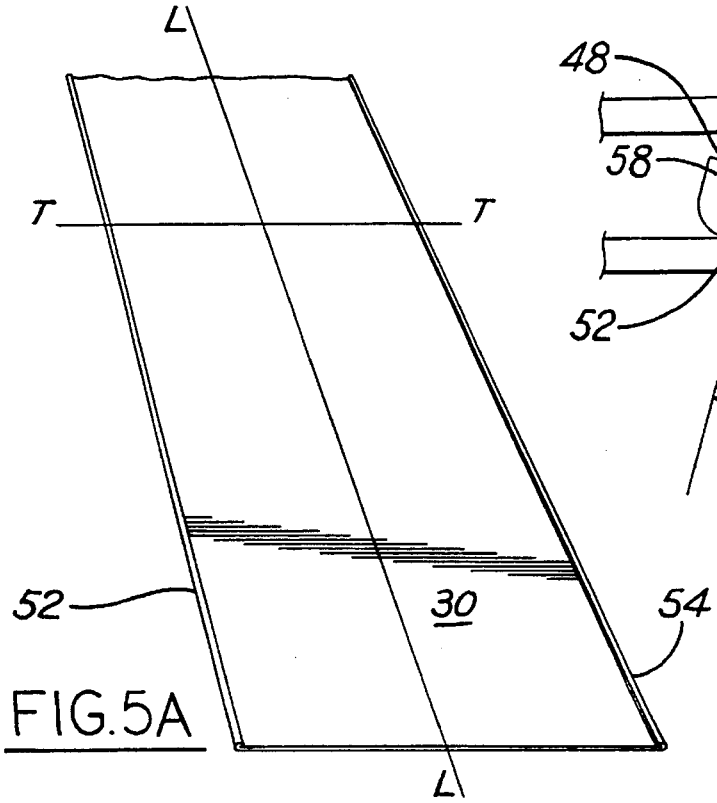
FIGS. 5A–5D illustrate the steps of the method of forming a tube according the present invention.
Figure 5B:
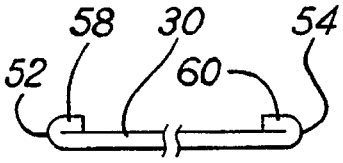
Figure 5C:
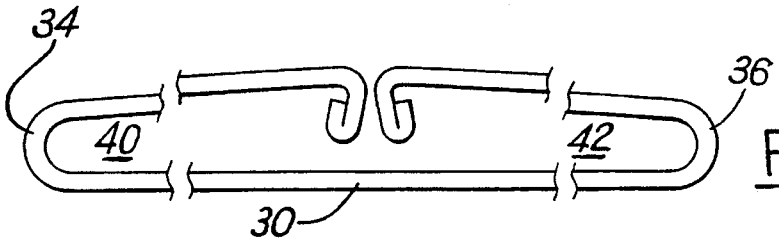
Figure 5D:
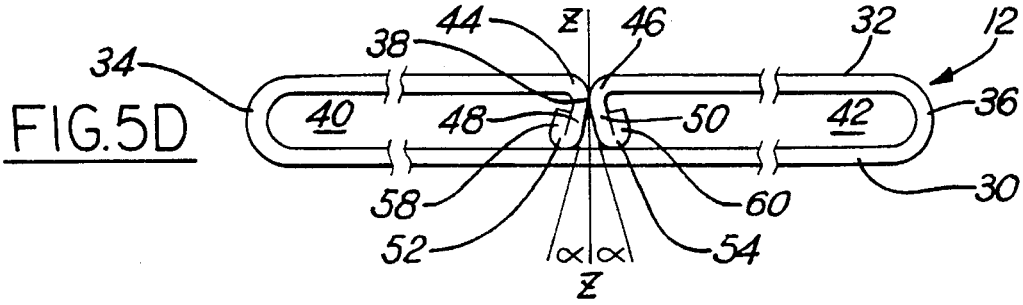

The tube 12 of the present invention is manufactured and according with the following steps has shown subsequently in FIGS. 5A–5D. Like elements have been given like reference numerals to ease in the understanding of the method of manufacturing a tube according to the present invention. Beginning with FIG. 5A, a generally planar sheet of elongate, deformable material 30 is provided which has a longitudinal axis designated by line L—L and a transverse axis designated by T—T. The sheet has a generally planar base 30 and pair of terminal edges 52,54 along the longitudinal length of the sheet. One side of the sheet is coated with a braze material which is commercially available and well known to those skilled in the art. The terminal edges 52, 54 of the sheet can either be flat or can include a bent over portion 58, 60 as shown in the preferred embodiment of FIG. 2. The bent over portion is formed first by simply rolling the outboard terminal edges of the planar sheet toward the longitudinal centerline of the sheet. Following this step, each of the terminal edges as shown in FIG. 5B, 52, 54 is folded toward one another until they meet in the longitudinal center of the sheet. In doing so, a pair of generally arcuate side portions 34, 36 are formed as is the top portion 32. In this step, the braze material is found on an outer surface of the top and side portions of the tube to be manufactured. Following this step, a pair of fluid passageways, 40, 42 are formed by bending the terminal edges 52, 54 inwardly toward the base at an acute angle relative to a vertical plane perpendicular to the base as explained above. The terminal edges 52,54 are bent inwardly until each of the edges contact the base 30 so as to form the braze material receiving fillet area 56 between the terminal edges 52, 54.

Following this step, the outside of the tubular member and fluid passageways are coated with a brazing flux material as is commonly known in the art. The tubular assembly is then heated at a predetermined temperature to melt the brazing material, the brazing flux causing the braze material to flow by capillary flow into the braze receiving fillet area 56 and substantially filling the entire area. The assembly is then cooled to solidify the molten braze material in the fillet area 56 to secure the leg portions 48, 50 and terminal edges 56, 58 to the base 30 to form the heat exchanger tube. As such, a braze seam 53 is formed along the top of the partition along the entire longitudinal length of the tube. As previously explained above, the acute angle formed by the terminal edges and the vertical plane can be between 10 and 20 degrees as with a preferred design being 15 degrees. Also, each of the bend portions is slightly arcuate relative to one another and is formed with a radius of curvature of between 0.005 and 0.010 inches. By forming the leg portions with this radius of curvature, increased burst strength is achieved.

Various modifications and alterations of the present invention will no doubt occur to those of skill in the art. Therefore, it is the following claims, including all equivalents which define the scope of the present invention.

What is claimed is:

1. A method of forming a tube for a heat exchanger, comprising the steps of:

providing a sheet of elongate, deformable material having a longitudinal axis and a transverse axis, the sheet defining a generally planar base and a pair of terminal edges along the longitudinal length thereof, and one side of the sheet being coated with a braze material;

folding each of the terminal edges toward one another until they meet so as to form a pair of generally arcuate side portions and a top portion, the braze material being on an outer surface of the side and top portions;

forming a pair of fluid passageways by bending the terminal edges inwardly toward the base so as to form an acute angle of between 10 to 20 degrees relative to a vertical plane perpendicular to the base of the sheet of material until each edge contacts the base, the step also including forming a braze material receiving area between the terminal edges;

coating an outside surface of the fluid passageways with a brazing flux;

heating the fluid passageways at a predetermined temperature to melt the braze material, the flux causing the braze material to flow by capillary flow into the braze material receiving area and substantially filling the area;

cooling the fluid passageways to solidify the molten braze material to secure the fluid passageways to one another and to secure the terminal edges to the base at a predetermined angle to form the heat exchanger tube.

2. The method according to claim 1, wherein the step of forming a pair of fluid passageways by bending the terminal edges at an acute angle further includes bending the terminal edges to form a braze seam comprising a pair of generally arcuate bend portions disposed along the longitudinal length of the sheet of material.

3. The method according to claim 2, wherein the step of forming a braze seam further includes forming a pair of bend portions each having a radius of curvature of between 0.005 and 0.010 inches.

4. The method according to claim 1, wherein the step of forming a braze receiving area further includes forming the braze receiving area to a cross-sectional area of 0.100 to 0.240 square mm relative to a vertical plane perpendicular to the plane of the base.

5. The method according to claim 1, wherein the step of cooling the fluid passageways to solidify the molten braze further includes securing one terminal edge to the other with the braze material.

6. The method according to claim 1, further including the step of folding each of the pair of terminal edges over a predefined amount to form a bead along each terminal edge prior to the step of folding each terminal edge toward one another.

7. A tube for a heat exchanger, the tube having a longitudinal and transverse axes, comprising:

an elongate, generally rectangularly-shaped member having a generally planar base, a top side including a braze seam and a pair of generally arcuate, opposed side portions interposed between the base and the top side, a partition extending from the top side to the base and defining a pair of adjacent, elongate fluid passageways, the partition including a pair of opposing, contacting bend portions and a leg portion depending from each of the pair of bend portions so as to contact the base; and wherein each of the leg portions is disposed at an acute angle of between 10 and 20 degrees relative to a vertical cross-sectional plane perpendicular to the plane of the base and spaced a predetermined distance apart so as to define a braze receiving area therebetween.

8. A tube according to claim 7, wherein each of the leg portions includes a terminal end contacting the base, the terminal ends being spaced apart by about 0.015 to 0.0235 inches.

9. A tube according to claim 8, wherein each terminal end includes a bent-over portion, the bent-over portions contacting the base.

10. A tube according to claim 9, wherein the braze material flows by capillary action into the braze receiving area upon heating the tube to a predetermined temperature.

11. A tube according to claim 7, wherein at least one side of the generally rectangularly-shaped member is coated with a braze material.

12. A tube for use in a heat exchanger for an automotive vehicle, the tube having a longitudinal and transverse axes, comprising:

an elongate, generally rectangularly-shaped member having a generally planar base, a top side including a braze seam and a pair of generally arcuate, opposed side portions interposed between the base and the top side, a partition extending from the top side to the base and defining a pair of adjacent, elongate fluid passageways, the partition including a pair of opposing, contacting bend portions and a leg portion depending from each of the pair of bend portions, each of the leg portions including a bent-over end portion contacting the base, the bent-over end portions being disposed at an angle of between 10 to 20 degrees relative to a vertical cross-sectional plane perpendicular to the plane of the base and spaced apart a distance of between 0.015 and 0.0235 inches so as to a define a braze receiving area therebetween.

* * * * *